US006263964B1

(12) United States Patent
Yang

(10) Patent No.: US 6,263,964 B1
(45) Date of Patent: Jul. 24, 2001

(54) HEAT EXCHANGING APPARATUS OF REFRIGERATION SYSTEM

(76) Inventor: Cheng-Fu Yang, P.O. Box 55-175, Taichung (TW)

( * ) Notice: Subject to any disclaimer, the term of this patent is extended or adjusted under 35 U.S.C. 154(b) by 0 days.

(21) Appl. No.: 09/438,512

(22) Filed: Nov. 12, 1999

(51) Int. Cl.[7] ..... G05D 23/00; F25B 27/00
(52) U.S. Cl. ..... 165/300; 62/238.6
(58) Field of Search ..... 165/48.1, 300; 62/238.6, 238.7

(56) References Cited

U.S. PATENT DOCUMENTS 4,711,094 * 12/1987 Ares et al. ..... 62/238.6 X
5,005,371 * 4/1991 Yonezawa et al. ..... 62/238.6
5,195,328 * 3/1993 Davis ..... 62/238.6 X
5,239,837 * 8/1993 Kowalski et al. ..... 62/238.6
5,904,051 * 5/1999 Schulak et al. ..... 62/238.6
5,906,104 * 5/1999 Schwartz et al. ..... 62/238.7 X
6,092,383 * 7/2000 Mertens ..... 62/238.6
6,148,909 * 11/2000 Osanai et al. ..... 165/300 X

* cited by examiner

*Primary Examiner*—Ira S. Lazarus
*Assistant Examiner*—Ljiljana V. Ciric

(57) ABSTRACT

A heat exchanging apparatus in cooperation with a refrigeration system. The apparatus comprises water lines, a thermos tank for storing water, a thermostat, heat collecting tanks in communication with the water lines having a refrigerant line passed therethrough for water to absorb the heat released by refrigerant transferred from the compressor to the condenser of the refrigeration system, a pump, and drive a controller wherein the pump pumps heated water to the thermos tank for storage. The drive controller is electrically connected to the thermos tank for measuring the temperature of the water for determining whether to stop an operation of the pump as compared to a predetermined temperature.

3 Claims, 3 Drawing Sheets

HEAT EXCHANGING APPARATUS OF REFRIGERATION SYSTEM

FIELD OF THE INVENTION

The present invention relates to a heat exchanger, and more particularly, to a heat exchanging apparatus of a refrigeration system.

BACKGROUND OF THE INVENTION

Conventionally, a refrigerant circulated in the lines of a large refrigerating machine or air conditioner functions in transferring heat energy to a compressor and so on. Referring to FIG. 1, a typical refrigeration system comprises a compressor 1 for compressing refrigerant, a condenser 2 for receiving the high-pressure, high-temperature refrigerant from the compressor 1 and cooling it into a refrigerant having a temperature approximately equal to atmospheric temperature, an expansion valve 4 and an evaporator 5 for receiving the atmospheric temperature refrigerant from the condenser 2 and vaporizing it to achieve a refrigeration effect. Further, it is often necessary to provide a cooling tower 3 in fluid communication with the condenser 2 for quickly lowering the temperature of the refrigerant. However, providing the cooling tower 3 consumes additional energy. From another aspect, while equipped with the cooling tower 3, such a typical refrigeration system is still disadvantageous due to the lengthy temperature-lowering process. To make it worse, only the refrigeration effect is somewhat satisfied, while energy is not effectively utilized in the refrigeration cycle as a whole.

Traditionally, a person uses a heater powered by gas or electricity to heat cold water to a desired high temperature for a predetermined time. One may think that if one can use latent energy not utilized by the refrigeration system to heat the cold water to an intermediate temperature such that then one can use such warm water directly from the tap in daily life. Alternatively, if higher temperature water is desired, one can use also a heater to heat the warm water to the desired high temperature. The design of the present invention is aimed at utilizing such latent energy for increasing the thermal efficiency of a refrigeration system.

SUMMARY OF THE INVENTION

It is therefore an object of the present invention to provide a heat exchanging apparatus of refrigeration system which extracts and utilizes the heat released by the refrigerant transferred from the compressor to the condenser during the temperature-lowering process for heating cold water to a predetermined temperature.

It is another object of the present invention to provide a heat exchanging apparatus for a refrigeration system which has a novel heat absorption process having the advantages of saving the material of the refrigerant line and reducing the operation time of a cooling tower, thereby saving energy.

The above and other objects, features and advantages of the present invention will become apparent from the following detailed description taken with the accompanying drawings.

DETAILED DESCRIPTION OF THE PREFERRED EMBODIMENTS

Figure 1:
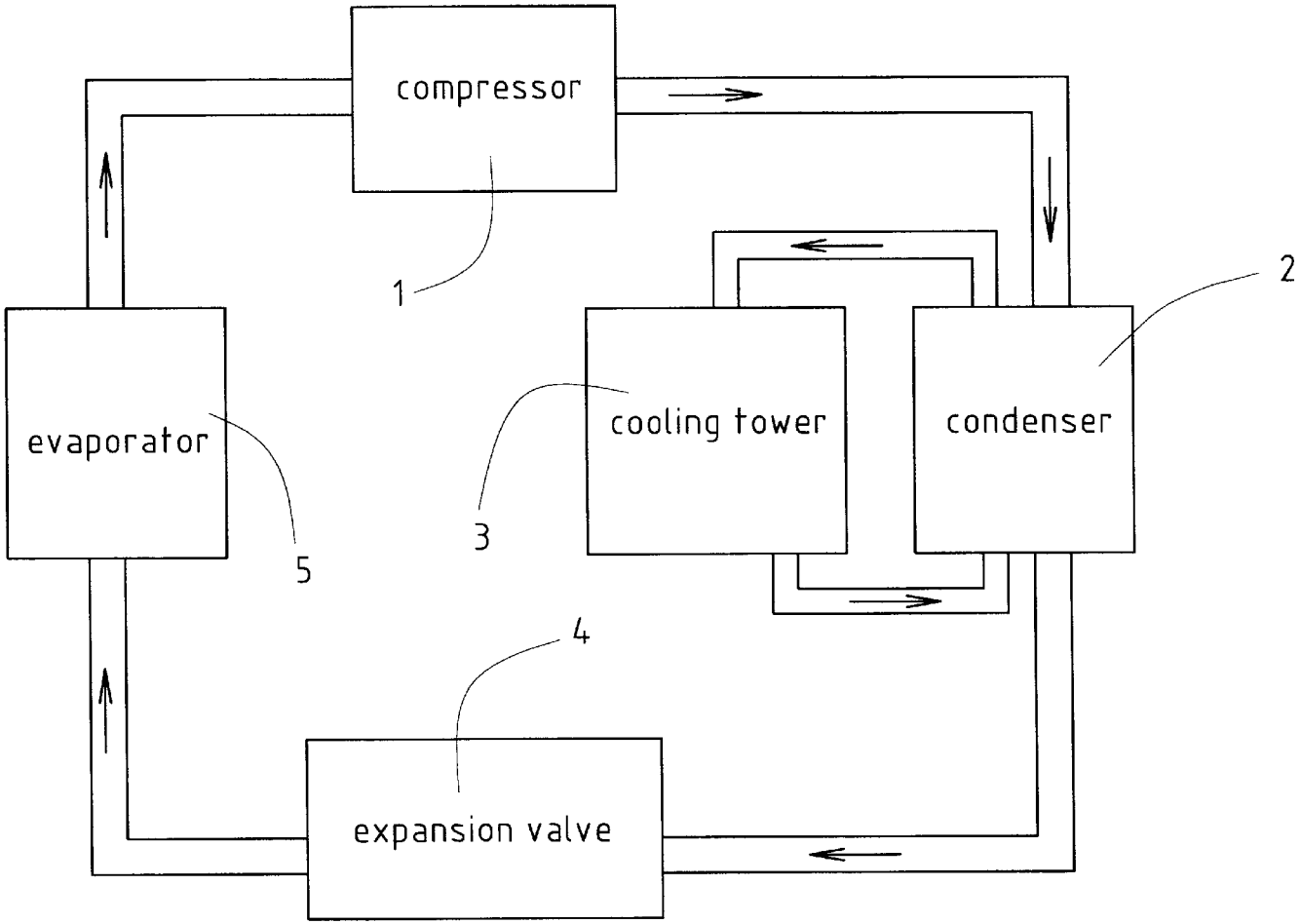
FIG. 1 PRIOR ART
FIG. 1 is a schematic block diagram of a prior art refrigeration system.
Figure 2:
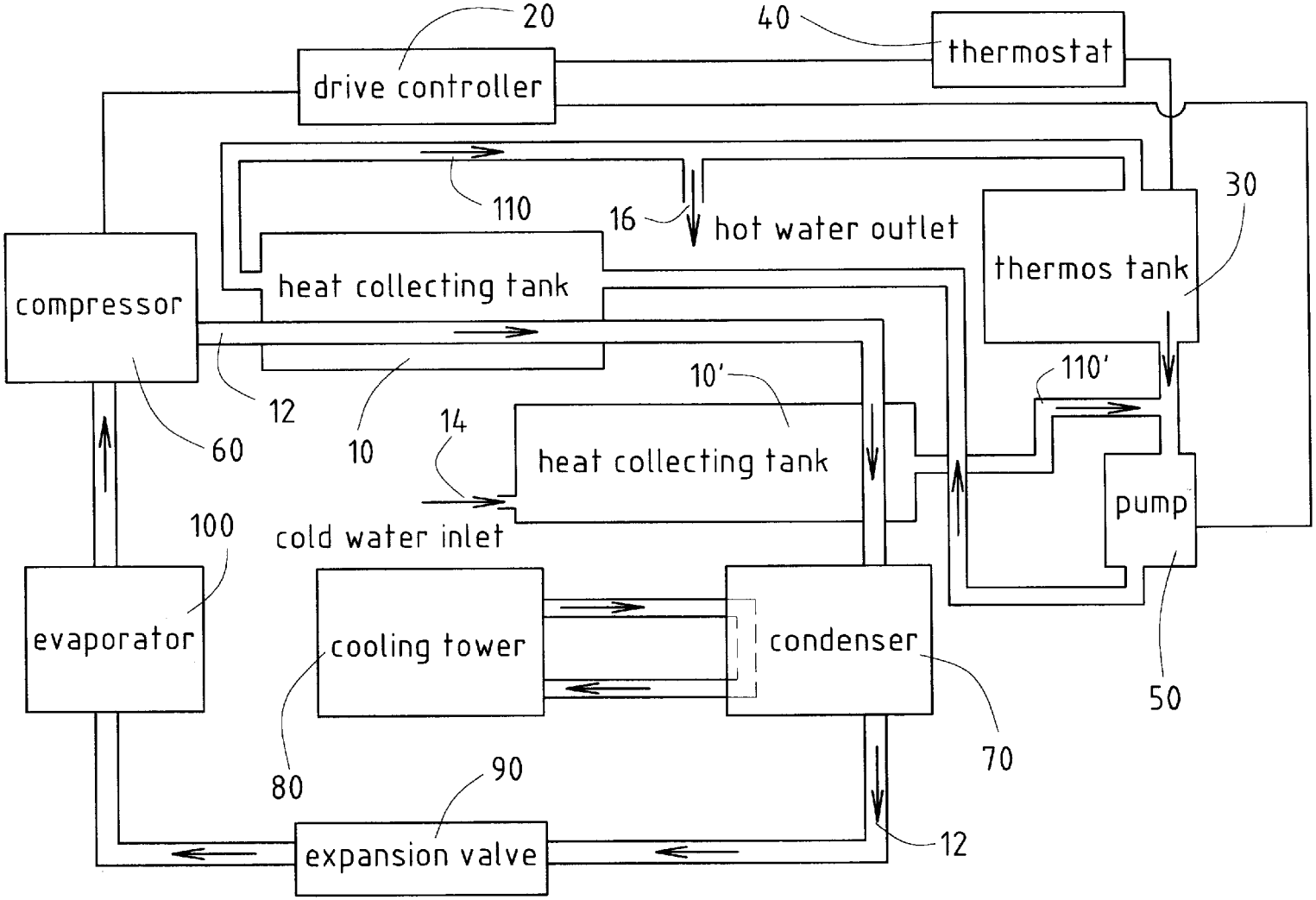
FIG. 2 is a schematic block diagram of a first embodiment of a heat exchanging apparatus for a refrigeration system of the present invention.

Referring to FIG. 2, there is shown a first embodiment of a heat exchanging apparatus for a refrigeration system constructed in accordance with the invention. The system of the present invention, comprising a plurality of heat collecting tanks (two heat collecting tanks 10 and 10' are shown), a drive controller 20, a thermos tank 30, a thermostat 40, and a pump 50, is in cooperation with a conventional refrigeration system such as one embodied in a commercially available refrigerating machine or air-conditioner. The conventional refrigeration system comprises a compressor 60, a condenser 70, a cooling tower 80, an expansion valve (or capillary tube) 90, and an evaporator 100. As is understood, a refrigerating machine (e.g., a refrigerator or ice machine) or an air-conditioner is operated to feed a low-temperature, low-pressure vapor refrigerant into the compressor 60 for compressing the refrigerant in order to generate a high-temperature, high-pressure refrigerant which is sent to the heat collecting tank 10 for storage through a one-way refrigerant line 12.

Each of the heat collecting tanks 10 or 10' is a fluid container. The refrigerant line 12 loops through the whole system in which one section thereof connects the compressor 60, the heat collecting tank 10 adjacent to the compressor 60, and the condenser 70. Two ports, in fluid communication with the water line 110, are provided at opposite ends of the heat collecting tank 10. The water line 110 is further in communication with the thermos tank 30 and the pump 50.

The other heat collecting tank 10' is adjacent to the condenser 70 having the refrigerant line 12 passing therethrough. One end of the heat collecting tank 10' is provided as a cold water inlet 14, while the other end of the heat collecting tank 10' is provided as an outlet for feeding water to the water line 110'. The water line 110' acts to transfer water to the water line 110 between the thermos tank 30 and the pump 50.

The drive controller 20 is a conventional electronic controller well-known to those skilled in the art and thus a detailed description thereof will be omitted herein for the sake of brevity. The drive controller 20 is electrically connected to the compressor 60 and the thermostat 40, respectively. The thermostat 40 is electrically connected between the drive controller 20 and the thermos tank 30 so as to measure the temperature of the water. If the temperature of the water exceeds a predetermined temperature, a signal will transmit to the drive controller 20 to cause the pump 50 to stop operating immediately for saving energy.

The thermos tank 30 is used for storing water. The thermos tank 30 is made of a material capable of keeping the temperature of the water at a constant level. One end of the thermos tank 30 is an inlet in fluid communication with the water line 110 for feeding water from the heat collecting tank 10. Note that a hot water outlet 16 is provided in the water line 110 between the heat collecting tank 10 and the thermos tank 30 for feeding hot water through a tap (not shown).

As stated above, the water line 110' is in fluid communication with the heat collecting tank 10'. Cold water is fed to the cold water inlet 14 of the heat collecting tank 10' and filled up therein for heating. The pump 50 then pumps the heated water to the heat collecting tank 10 through the water line 110. This heat absorption process continues until the temperature of water in the thermos tank 30 exceeds a predetermined temperature. At this time, pump 50 is stopped immediately.

It is seen that the high-temperature refrigerant contained in the refrigerant line 12 fed from the compressor 60 has transferred heat energy to the cold water in the heat collecting tanks 10 and 10'. That is to say, the cold water is heated and the refrigerant entering the condenser 70 is at an intermediate temperature lower than that of the refrigerant leaving the compressor 60. Note that the gaseous refrigerant leaving the compressor 60 has not changed its gaseous state. The cooling tower 80 is provided and is in the loop with the condenser 70 for further lowering the intermediate temperature of the refrigerant to an even lower one. Note that the cooling tower 80 continues to absorb heat from the refrigerant in the condenser 70 until the gaseous refrigerant becomes a liquid having a temperature approximately equal to the atmospheric temperature. The liquid refrigerant then is transferred to the expansion valve (or capillary tube) 90 through the refrigerant line 12. The expansion valve 90 is operated to lower the pressure of the refrigerant to become a low-pressure, low-temperature liquid refrigerant which in turn transfers to the evaporator 100 through a line. The evaporator 100 is operated to release heat for the liquid refrigerant to absorb for vaporizing into a low-pressure, low-temperature gaseous refrigerant which, in turn, transfers to the compressor 10 to compress the refrigerant, thus completing a refrigeration cycle.

The operation of the pump 50 is controlled by the drive controller 20. In detail, the pump 50 can draw cold water from outside into the heat collecting tank 10' to heat and can draw water stored in the thermos tank 30 into the heat collecting tank 10. As such, water is cycled through the heat collecting tank 10, the thermos tank 30, and the pump 50 continuously until the water temperature in the thermos tank 30 detected by the thermostat 40 reaches a predetermined value. At this time, the pump 50 is stopped. As stated above, the user may use a tap to drain hot water from the water line 110. In view of the foregoing, the present invention completely utilizes the heat released by the refrigerant from the compressor 60 to the condenser 70 through the heat collecting tanks 10 and 10'. As a result, the energy to heat cold water to hot water (the temperature thereof is about 30° C. to 50° C.) as required by prior art techniques is saved by the present invention, thereby increasing thermal efficiency of the refrigeration system.

Figure 3:
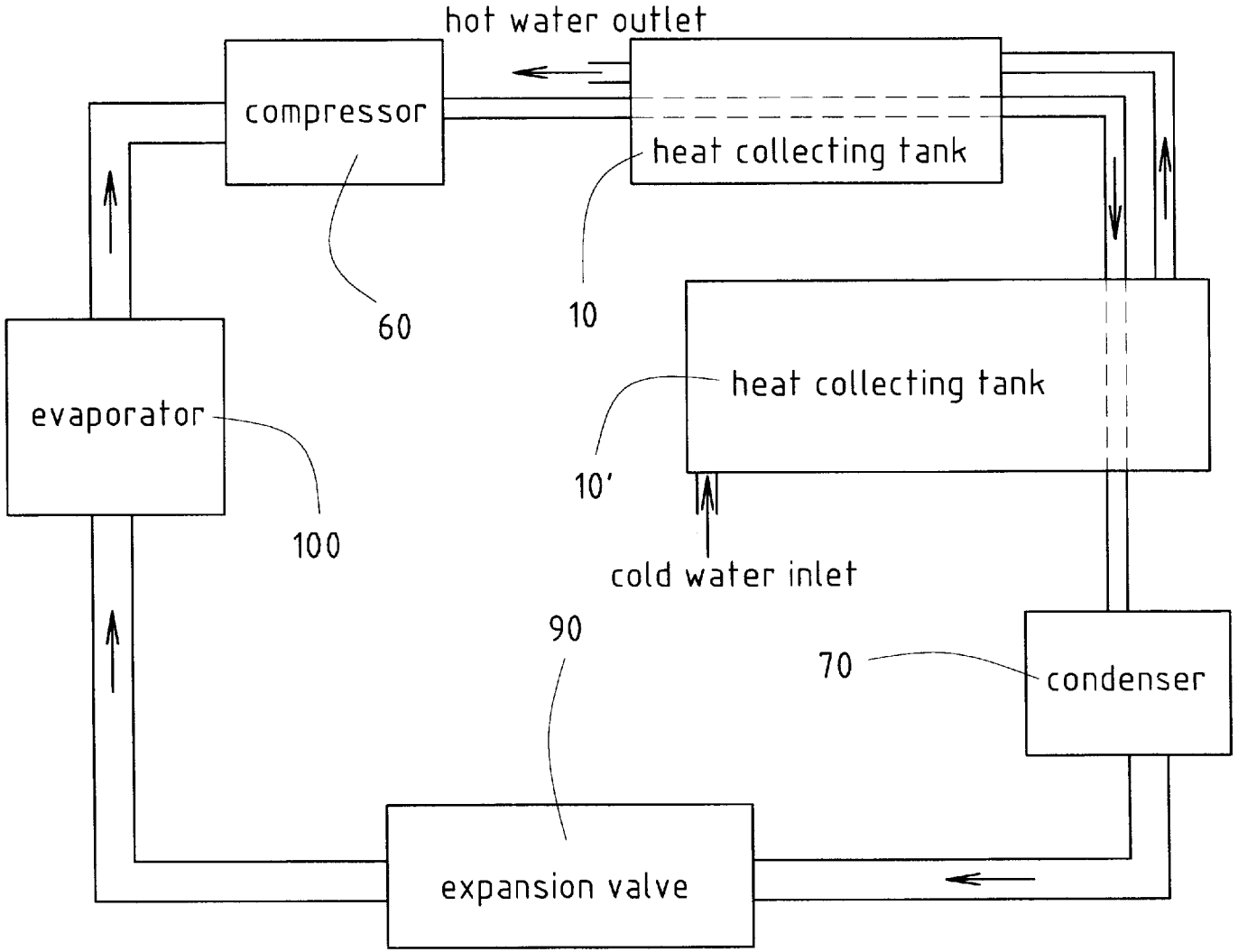
FIG. 3 is a schematic block diagram of a second embodiment of a heat exchanging apparatus for a refrigeration system of the present invention.

FIG. 3 illustrates a second embodiment of heat exchanging apparatus of the refrigeration system of the present invention. The configuration of the second embodiment is similar to that of the first embodiment. In detail, the refrigeration system comprises an evaporator 100, a compressor 60, a plurality of heat collecting tanks (10 and 10' are shown), a condenser 70, and an expansion valve 90; all are interconnected by a line. Note that the heat collecting tanks 10 and 10' are also made of a material capable of keeping the temperature of the water at a constant level but their sizes are larger than those of the first embodiment. In other words, the heat collecting tanks 10 and 10' serve for maintaining the temperature and for water storage. Cold water is fed into the heat collecting tank 10' adjacent to the condenser 70 for primary heating. Then the heated water is introduced to the compressor 60 adjacent to the compressor 60 for secondary heating through the water line 110. As shown, hot water is drained out of the heat collecting tank 10 when a tap (not shown) is opened. It is seen that the configuration of the second embodiment is simpler than that of first embodiment.

INDUSTRIAL APPLICATIONS

The present invention can be utilized to generate hot water for our daily use, especially in winter without additional energy.

While the invention herein disclosed has been described by means of specific embodiments, numerous modifications and variations could be made thereto by those skilled in the art without departing from the scope of the invention set forth in the claims.

What is claimed is:

1. A heat exchanging apparatus in cooperation with a refrigeration system including a compressor, a condenser, an expansion valve, and an evaporator being interconnected by a refrigerant line, the apparatus comprising:

a first water line;

a second water line;

a thermos tank for storing water made of a material capable of keeping the temperature of the water at a constant level, one end of the thermos tank being an inlet in fluid communication with the first water line;

a thermostat;

a plurality of first heat collecting tanks;

a plurality of second heat collecting tanks;

a pump for pumping water to the first heat collecting tanks through the first water line; and a drive controller;

wherein one of the first heat collecting tanks adjacent to the compressor has the refrigerant line passing therethrough, two ports, at opposite ends of the first heat collecting tank are in fluid communication with the first water line which connects the pump through the thermos tank for forming a loop, one of the second heat collecting tanks adjacent to the condenser has the refrigerant line passing therethrough, one end of each of the second heat collecting tanks is provided as a cold water inlet, and the other end of each of the second heat collecting tanks is provided as an outlet for feeding water to the first water line through the second water line, and the drive controller is electrically connected to the compressor and the thermostat which is electrically connected to the thermos tank so as to measure the temperature of the water for determining whether to stop operation of the pump as compared to a predetermined temperature.

2. The apparatus as recited in claim 1, wherein one or more walls of each of the first and the second heat collecting tanks are made of a material capable of keeping the temperature of water at a constant level.

3. The apparatus as recited in claim 1, further comprising a hot water outlet provided in the first water line.

* * * * *